US007413005B2

(12) United States Patent
Heine et al.

(10) Patent No.: US 7,413,005 B2
(45) Date of Patent: Aug. 19, 2008

(54) HEAT EXCHANGER, ESPECIALLY CHARGE AIR COOLER FOR MOTOR VEHICLES

(75) Inventors: Reinhard Heine, Remseck (DE); Reinhard Kull, Ludwigsburg (DE)

(73) Assignee: BEHR GmbH & Co. KG, Stuttgart (DE)

( * ) Notice: Subject to any disclaimer, the term of this patent is extended or adjusted under 35 U.S.C. 154(b) by 167 days.

(21) Appl. No.: 10/580,015

(22) PCT Filed: Nov. 10, 2004

(86) PCT No.: PCT/EP2004/012720

§ 371 (c)(1),
(2), (4) Date: May 19, 2006

(87) PCT Pub. No.: WO2005/050120

PCT Pub. Date: Jun. 2, 2005

(65) Prior Publication Data

US 2007/0144718 A1 Jun. 28, 2007

(30) Foreign Application Priority Data

Nov. 20, 2003 (DE) ..... 103 54 382

(51) Int. Cl.
*F28F 9/007* (2006.01)

(52) U.S. Cl. ..... 165/173; 165/906; 165/174

(58) Field of Classification Search ..... 165/76, 165/178, 906
See application file for complete search history.

(56) References Cited

U.S. PATENT DOCUMENTS

| | | | | |
|---|---|---|---|---|
| 1,847,743 | A * | 3/1932 | Anderson | 165/76 |
| 2,258,041 | A * | 10/1941 | Young | 403/202 |
| 4,396,059 | A * | 8/1983 | Banner et al. | 165/134.1 |
| 4,754,538 | A * | 7/1988 | Stewart et al. | 29/890.031 |
| 6,006,430 | A * | 12/1999 | Fukuoka et al. | 29/890.03 |
| 2005/0263263 | A1 * | 12/2005 | Merklein et al. | 165/76 |

FOREIGN PATENT DOCUMENTS

| | | |
|---|---|---|
| DE | 198 57 435 A1 | 6/1999 |
| DE | 199 62 861 A1 | 6/2001 |
| DE | 100 57 190 A1 | 5/2002 |
| JP | 2-037289 A | 2/1990 |

* cited by examiner

*Primary Examiner*—Allen J Flanigan
(74) *Attorney, Agent, or Firm*—Foley & Lardner LLP

(57) ABSTRACT

The invention relates to a heat exchanger, especially a charge air cooler (5) for motor vehicles. Said heat exchanger comprises a heat exchange block which is constituted of flat tubes (6) having flat tube ends and ribs (7) and tube bottoms (8) having ventilation passages (9) in which the flat tube ends are received and welded together. The heat exchanger also comprises collecting tanks that can be placed on the tube bottoms (8) and means for deflecting the flow in the feed section of the flat tube ends. The inventive heat exchanger is characterized in that the means for deflecting flow (deflection means 2) and means for reinforcing the flat tube ends (reinforcing means) are configured as an integrated structural component (1).

11 Claims, 2 Drawing Sheets

Figure 1:
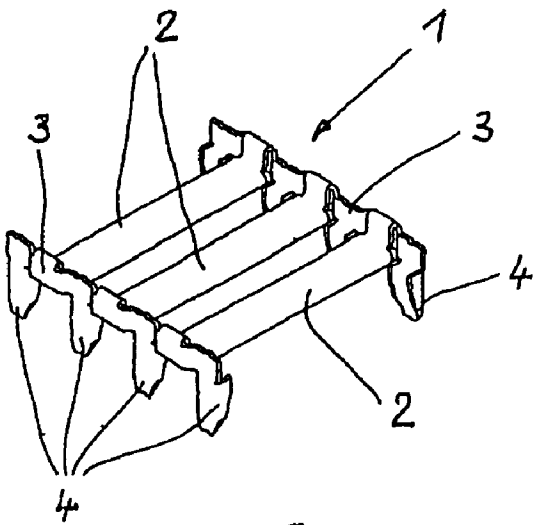

VIII
X

HEAT EXCHANGER, ESPECIALLY CHARGE AIR COOLER FOR MOTOR VEHICLES

The invention relates to a heat exchanger, in particular a charge air cooler for motor vehicles. A conventional charge air cooler is known from DE-A 198 57 435.

In known heat exchangers, the tubes through which a heat transfer medium flows open out into a tube plate which is conventionally connected to a collecting tank. The tube/plate connection is often of such a design that the tube plate has apertures which are formed as inwardly directed passages and into which the tubes are inserted and project beyond the passages in the inward direction. The tubes, often flat tubes, are soldered to the passages and/or to the plate. This tube/plate connection geometry is unfavorable in terms of flow for the inflow of the heat transfer medium from the collecting tank into the tube ends, in particular in charge air coolers, where the charge air has a relatively high flow speed. There is therefore the problem of a relatively high pressure drop in the inlet region of the tube ends. DE-A 198 57 435 has therefore proposed a so-called deflecting plate which is placed on the tube plate and covers the regions between the passages or tube ends. The deflecting plate has rounded-off profiles, so that the flow, that is to say the flow of charge air, is deflected and the pressure losses are reduced. Said deflecting plate is preferably produced from plastic, placed on the metallic tube plate, and held on the metallic tube plate by mechanical means. On account of the relatively high charge air temperature and the high flow speeds, this solution is not without its problems.

Another problem in heat exchangers of said type, in particular in charge air coolers having flat tubes, is that the corner regions and narrow sides of the flat tubes are subjected to particularly high loadings which result from the internal pressure within the collecting tank and the design of the tube plate. Said stress peaks in the region of the tube/plate connections can lead to cracks in the tube, that is to say to leakages from the heat exchanger. The applicant has therefore proposed, for coolant radiators, to reinforce the tube ends of flat tubes by means of clamping elements which can be inserted and can be soldered to the flat tube ends. Said clamping elements have four lateral limbs which are inserted into, and are soldered to, two adjacent flat tubes. Only two tubes, that is to say those which are subjected to the highest loading, in general the outermost tubes of the heat exchanger, are therefore reinforced by means of said clamping element. In addition, the throughflow cross-section of the coolant tube in question is considerably reduced, so that there is an increased pressure drop there.

It is an object of the present invention, for a heat exchanger of the type mentioned in the introduction, both to keep the pressure drop in the inlet region of the tubes low and also to reinforce the tube/plate connection in its critical regions.

According to the invention, a single integrated component is provided which both favorably influences the flow in the inlet region of the tubes and also reinforces the tube ends. Said component therefore fulfils two functions and can be assembled in a simple manner, that is to say in one working operation.

According to a first embodiment of the invention, the integrated component is produced from a metallic material, in particular an aluminum material or an aluminum alloy, the reinforcing means being soldered to the flat tube ends. This results in a cohesive stiffening or reinforcement of the tube/plate connection, and the danger of crack formation is considerably reduced.

In a further advantageous embodiment of the invention, the integrated component with deflection and reinforcing means is produced from one sheet metal blank, that is to say advantageously by punching, stamping and edge bending. This brings about the advantage of low production costs without the two functions of flow deflection and tube reinforcement being adversely affected.

According to one advantageous embodiment of the invention, the integrated component has fingers or "prongs" in the manner of a rake which are inserted into the flat tubes in the region of their narrow sides. The fingers or prongs are connected to one another, that is to say from tube to tube, by means of longitudinal webs, which in turn are physically connected to one another by means of transverse webs, said transverse webs covering the regions between the narrow sides of the flat tubes and therefore acting as deflecting elements for the flow. Two adjacent transverse webs therefore in each case form a type of inlet funnel for one flat tube end. This results in a low pressure drop.

In a further advantageous embodiment of the invention, the integrated component extends over the entire tube plate, so that the inflow losses for each tube are reduced in equal measure, giving a relatively low pressure drop for the entire heat exchanger. At the same time, the tubes are reinforced by inserting the integrated fingers or "prongs". The component can however also be designed in such a way that fingers are only provided for the critical tube/plate connections, for example the outermost tubes. This would avoid unnecessary reinforcement of non-vulnerable tubes, and would therefore save weight.

Figure 3:
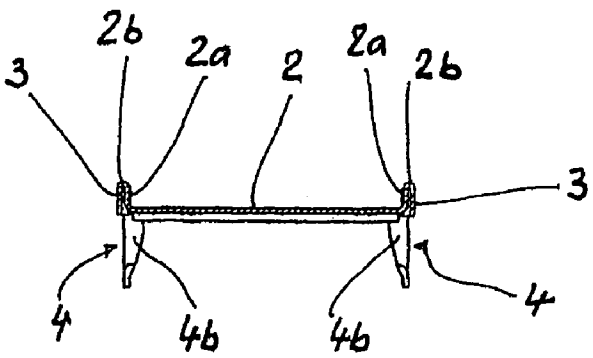
Figure 5:
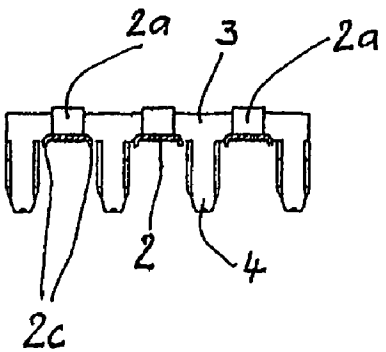
Figure 2:
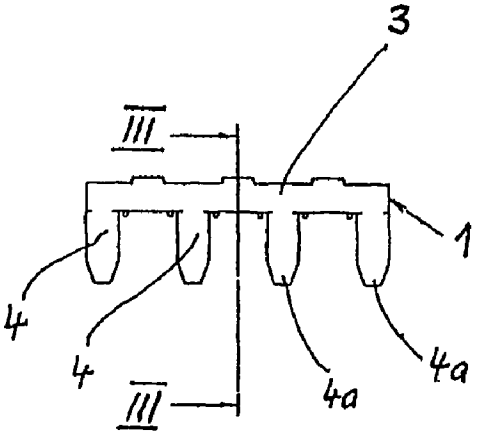
Figure 4:
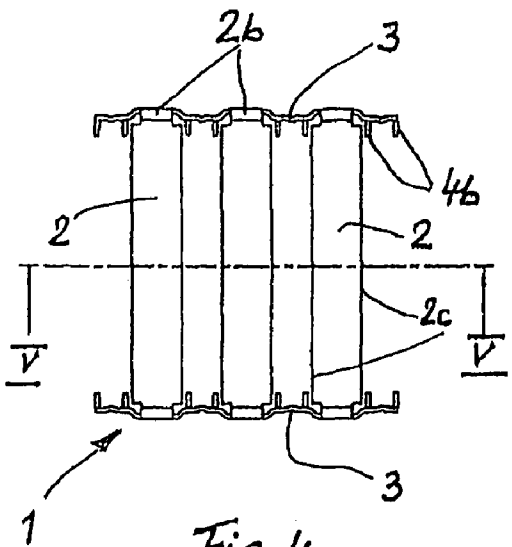
Figures 6, 7, 8, 9, 10:
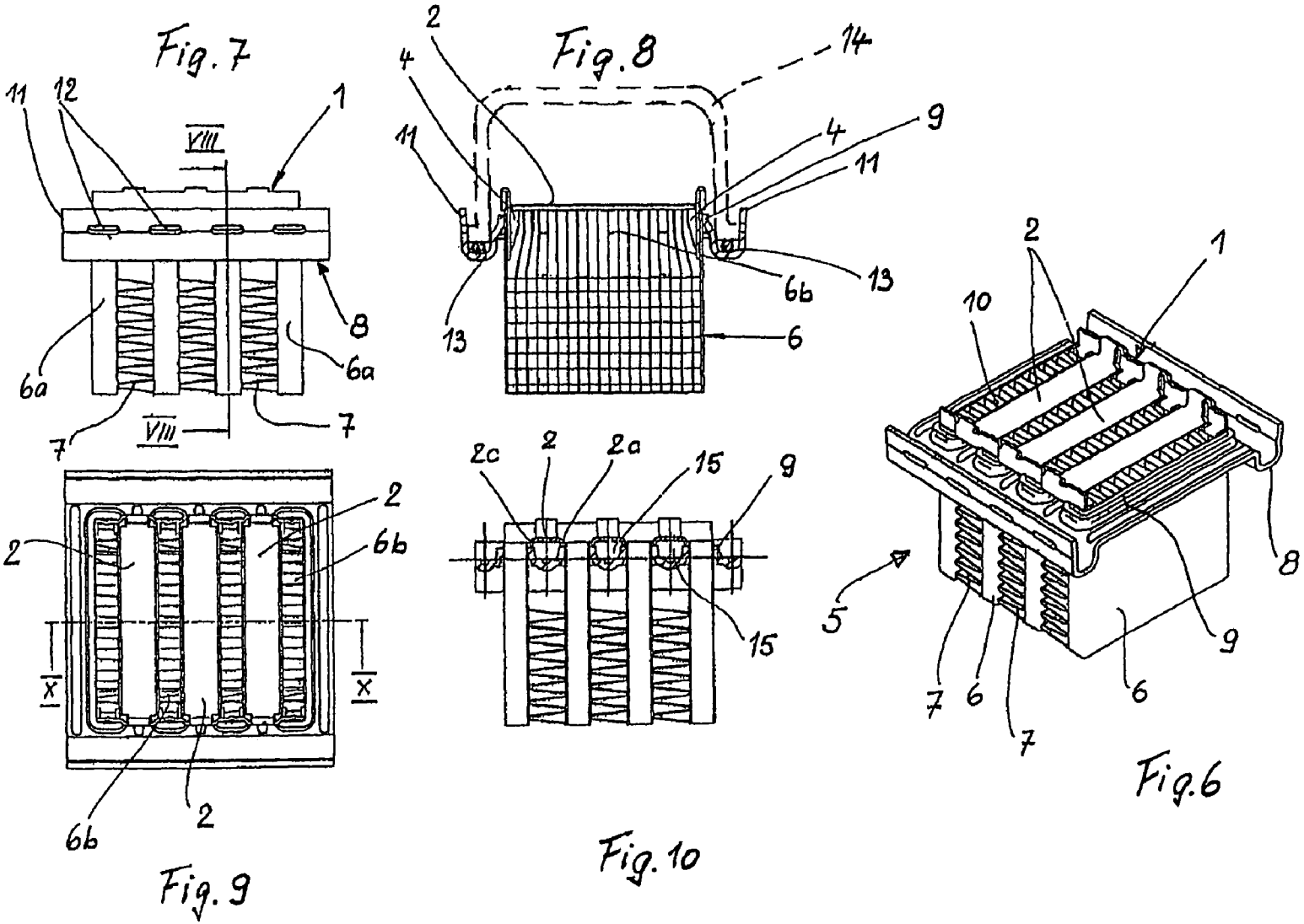

One exemplary embodiment of the invention is described in more detail in the following and is illustrated in the drawing, in which:

FIG. 1 shows an integrated component for flow deflection and tube reinforcement in a perspective illustration, FIG. 2 shows the component according to FIG. 1 in a side view, FIG. 3 shows the component in a section along the line III-III in FIG. 2, FIG. 4 shows a view from above of the component from FIG. 1, FIG. 5 shows a section through the component along the line V-V in FIG. 4, FIG. 6 shows part of a charge air cooler with the integrated component from FIG. 1 assembled, FIG. 7 shows a side view of the charge air cooler from FIG. 6, FIG. 8 shows a section along the line VIII-VIII in FIG. 7, FIG. 9 shows a view from above of the charge air cooler with the integrated component and FIG. 10 shows a section along the line X-X in FIG. 9.

FIG. 1 shows a perspective illustration of an integrated component 1 which is designed for a charge air cooler illustrated in FIGS. 6 to 10 and serves both to influence the charge air flow and also to reinforce the tubes of the charge air cooler. The integrated component 1 is substantially composed of three elements, specifically transverse webs 2, longitudinal webs 3 and fingers 4. The number of transverse webs 2 and fingers 4 is arbitrary, that is to say at least one transverse web 2 and at least two fingers 4 on each side which are in each case connected to one another by means of one longitudinal web 3. The entire integrated component 1 is preferably produced from an aluminum sheet, that is to say is initially punched out, stamped and edge-bent from a blank. The transverse webs 2 serve to influence the charge air flow, and the fingers 4 are inserted into the tubes for reinforcement.

FIG. 2 shows the component 1 from the side, that is to say with a view onto the four fingers 4, which are connected to one another by means of the longitudinal web 3. As mentioned, the number of fingers is arbitrary and, accordingly, the length of the longitudinal webs 3 is variable. The fingers 4 have tips 4*a* which are slightly beveled so that they can be better inserted into the tubes (not illustrated here).

FIG. 3 shows a section along the line III-III in FIG. 2, that is to say the section runs through one of the transverse webs 2 and shows lateral angled regions 2*a* which merge into the longitudinal webs 3 via a 180-degree edge-bent portion 2*b*. The fingers 4 have a beveled U-shaped profile with lateral limbs 4*b*, the U-shaped profile being matched to the inner cross-section of the tubes (not illustrated here).

FIG. 4 shows a view from above of the component 1 having transverse webs 2, it being possible to see the limbs 4*b* of the U-shaped profile which extend inward from the profiled longitudinal webs 3. On account of the 180-degree edge-bent portions 2*b*, the longitudinal webs 3 are offset outward slightly in the region of the transverse webs 2—this results in the profiled course of the longitudinal webs 3.

FIG. 5 shows a section along the line V-V, the edge-bent faces 2*a* of the transverse webs 3 appearing face-on. The transverse webs 2 have longitudinal sides 2*c* which are slightly edge-bent downward, that is to say in the direction of the fingers 4. This results in a slightly outwardly bent profile, that is to say a convex profile of the transverse webs 2.

FIG. 6 shows part of a charge air cooler 5, without collecting tanks, having flat tubes 6, between which are arranged corrugated fins 7. The flat tubes 6 open out into a tube plate 8 which has inwardly directed passages 9 for holding the tubes 6. The tube plate 8 is partially covered, between the passages 9, by the transverse webs 2 of the above-described integrated component 1, while the fingers 4 (not illustrated here) of said integrated component 1 are inserted into the tubes 6. Turbulence inserts 10, which can be soldered in, are arranged in the interior of the tubes 6. Compressed, that is to say hot, charge air flows through the tubes 6, while ambient air, which serves for cooling the charge air, flows over the corrugated fins 7.

FIG. 7 shows the charge air cooler 5 in a view from the front, that is to say with a view of the end face which is formed by narrow sides 6*a* of the flat tubes 6 and by the corrugated fins 7. The tube plate 8 has an edge strip 11 with longitudinal slots 12 which serve for fastening an air tank or collecting tank (not illustrated here). The integrated component 1 projects slightly beyond said edge strip 11 in the upward direction.

FIG. 8 shows a section along the line VIII-VIII in FIG. 7, that is to say through a flat tube 6 with a flat tube end 6*b* which is soldered to the passage 9 of the plate 8. The narrow sides of the passage 9 merge outwardly into a continuously encircling channel 13 which is adjoined by the upwardly disposed edge strip 11. The channel 13 serves to hold a seal, illustrated by dashed lines, onto which the charge air tank 14, illustrated by dashed lines, is placed and then crimped by means of the edge strip 11. It is said plate and passage geometry that results in the stress peaks, already mentioned in the introduction, in the region of the narrow sides 6*a* of the tube/plate connections. The fingers 4 of the integrated component 1 are therefore inserted in the region of the narrow sides of the tube ends 6*b*. As can be seen from the drawing, said fingers 4 bear tightly against the inner wall of the tube ends 6*b*, that is to say also in the region of the passage 9. The fingers 4 of the integrated component 1 are soldered to the inner wall of the tube ends 6*b* and thus bring about a cohesive reinforcement, that is to say a partial increase in the wall thickness of the flat tubes 6, in these corner regions of the tube ends 6*b*.

FIG. 9 shows a view from above, that is to say in the direction of the tube plate 8. The intermediate spaces between the longitudinal sides of the flat tube ends 6*b* are covered by the transverse webs 2 of the integrated component 1. On account of the previously described convex profile of the transverse webs 2, the charge air flow is influenced in the direction of the tube ends 6*b*, as can be seen in particular from the next figure.

FIG. 10 shows a section along the line X-X in FIG. 9. The convex profile of the transverse webs 2 with their edge-bent longitudinal sides 2*c* can be seen here. The longitudinal sides 2*c* thus form a type of inflow funnel or inflow nozzle for each tube end 6*b*, as a result of which the flow losses as the charge air flows into the tube ends 6*a* are considerably reduced. This is particularly apparent if the tube plate 8 is provided with inwardly directed passages 9 without the transverse webs 2. One bead 15, which runs in the transverse direction of the plate and is approximately U-shaped on account of the longitudinal sides of the passages 9, is situated in each case between two adjacent passages 9. Said transverse beads 15 would cause considerable turbulence of the charge air as it flows into the tube ends 6*b*. This is however prevented by the transverse beads 15 being covered by means of the transverse webs 2. A covering therefore results which is favorable in terms of flow, the edge-bent longitudinal sides 2*c* of the transverse webs resting on the upper edges of the passages and being laterally supported against the projecting tube ends 6*b*. The soldering of the fingers 4 in the tube ends 6*b* also brings about a fixed connection, that is to say a secure positioning, of the integrated component 1 on the plate 8, so that vibrations, in conjunction with possible noise, on account of the high charge air speeds are eliminated.

As already mentioned, the length of the integrated component, that is to say the number of transverse webs and fingers, is variable—it complies with the number of tube ends to be reinforced. The tube ends which are subjected to the highest loading are generally situated in the outer or outermost regions of the tube plate, so that an integrated component with, for example, three to five transverse webs would be sufficient. It is however likewise possible—if this is necessary on account of the loading of the tube plate—to cover the entire tube plate with one integrated component, so that one transverse web, which is favorable in terms of flow, is arranged in each case between two adjacent tube ends. If the tube plate is covered completely, the fingers in the central region of the integrated component can be removed, that is to say cut off during production, so that the central tubes which are subjected to less intense loading are not reinforced. The integrated component according to the invention can thus be of variable design and can be matched to the respective loadings of the charge air cooler or heat exchanger.

REFERENCE SYMBOLS

1 Integrated component
2 Transverse web
2*a* Edge-bent face
2*b* 180-degree edge-bent portion
2*c* Edge-bent longitudinal side
3 Longitudinal web
4 Finger
4*a* Finger tip
4*b* Lateral limb
5 Charge air cooler
6 Flat tube
6*a* Narrow side
6*b* Tube end
7 Corrugated fin
8 Tube plate
9 Passage

10 Turbulence insert
11 Edge strip
12 Longitudinal slot
13 Channel
14 Charge air tank
15 Transverse bead

The invention claimed is:

1. A heat exchanger, comprising:

a heat exchanger block comprising flat tubes with flat tube ends, fins, and tube plates that form apertures, wherein the apertures are formed as passages and the flat tube ends are held and soldered in position with the apertures, collecting tanks which are placed on the tube plates, wherein the collecting tanks include deflecting elements configured to deflect a flow in an inlet region of the flat tube ends, and reinforcing devices configured to reinforce the flat tube ends, wherein the deflecting elements and the reinforcing devices are formed as an integrated component, wherein the reinforcing devices are formed as fingers having a U-shaped profile, wherein the reinforcing devices are connected to one another by longitudinal webs, wherein the deflecting elements are formed as transverse webs and are arranged between the flat tube ends, wherein the transverse webs are connected to the longitudinal webs.

2. The heat exchanger as claimed in claim 1, wherein the deflection elements and the reinforcing devices are produced from a metallic material, and in that the reinforcing means are soldered to the flat tube ends.

3. A heat exchanger, comprising:

a heat exchanger block comprising flat tubes with flat tube ends, fins, and tube plates that form apertures, wherein the apertures are formed as passages and the flat tube ends are held and soldered in position with the apertures, collecting tanks which are placed on the tube plates, wherein the collecting tanks include deflecting elements configured to deflect a flow in an inlet region of the flat tube ends, and reinforcing devices configured to reinforce the flat tube ends, wherein the deflecting elements and the reinforcing devices are formed as an integrated component, wherein the deflecting elements and reinforcing devices are produced from one sheet metal blank.

4. The heat exchanger as claimed in claim 3 wherein the deflecting elements and reinforcing devices are produced from one metal sheet by punching, stamping and edge bending.

5. The heat exchanger as claimed in claim 1, wherein the reinforcing devices are inserted into the flat tube ends.

6. The heat exchanger as claimed in claim 5, wherein the reinforcing devices are matched to an inner contour of the flat tube ends.

7. The heat exchanger as claimed in claim 1, wherein the transverse webs have an outwardly curved profile and form inlet funnels for the flat tube ends.

8. The heat exchanger as claimed in claim 1, wherein the integrated component is configured to be inserted into at least two flat tube ends.

9. The heat exchanger as claimed in claim 1, wherein the heat exchanger is configured as a charge air cooler for motor vehicles.

10. The heat exchanger as claimed in claim 2, wherein the deflection elements and the reinforcing devices are produced from an aluminum material.

11. The heat exchanger as claimed in claim 6, wherein the reinforcing devices are matched to the inner contour of the flat tube ends in a region of narrow sides of the flat tube ends.

* * * * *